US007488459B2

(12) United States Patent
Stell et al.

(10) Patent No.: US 7,488,459 B2
(45) Date of Patent: Feb. 10, 2009

(54) APPARATUS AND PROCESS FOR CONTROLLING TEMPERATURE OF HEATED FEED DIRECTED TO A FLASH DRUM WHOSE OVERHEAD PROVIDES FEED FOR CRACKING

(75) Inventors: Richard C. Stell, Houston, TX (US); James N. McCoy, Houston, TX (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 254 days.

(21) Appl. No.: 10/851,546

(22) Filed: May 21, 2004

(65) Prior Publication Data

US 2005/0261536 A1 Nov. 24, 2005

(51) Int. Cl.
*B01J 19/00* (2006.01)
*C10G 9/00* (2006.01)

(52) U.S. Cl. ..... 422/198; 208/130; 208/132; 208/106; 208/107

(58) Field of Classification Search ..... 208/106, 208/130, 132
See application file for complete search history.

(56) References Cited

U.S. PATENT DOCUMENTS

| | | | | | |
|---|---|---|---|---|---|
| 1,936,699 | A | | 11/1933 | Weaver | 196/116 |
| 1,984,569 | A | | 12/1934 | Cooke et al. | 196/66 |
| 2,091,261 | A | | 8/1937 | Alther | 196/49 |
| 2,158,425 | A | | 5/1939 | Ragatz | 196/73 |
| 2,431,177 | A | * | 11/1947 | Iager et al. | 122/35 |
| 3,291,573 | A | | 12/1966 | Frescoln | 23/284 |
| 3,341,429 | A | | 9/1967 | Fondrk | 203/95 |
| 3,413,211 | A | | 11/1968 | Becraft et al. | 208/93 |
| 3,487,006 | A | | 12/1969 | Newman et al. | 208/93 |
| 3,492,795 | A | | 2/1970 | Guerrieri | 55/463 |

(Continued)

FOREIGN PATENT DOCUMENTS

| | | |
|---|---|---|
| DE | 1093351 | 11/1960 |

(Continued)

OTHER PUBLICATIONS

Walas, Stanley M.; Chemical Process Equipment - Selection and Design; 1990, Butterworth-Heinemann, a division of Reed Publishing (USA) Inc.; Chapter 10, p. 296.*

(Continued)

*Primary Examiner*—Alexa D. Neckel
*Assistant Examiner*—Kaity V. Handal

(57) ABSTRACT

An apparatus and process are provided for cracking hydrocarbonaceous feed, wherein the temperature of heated effluent directed to a vapor/liquid separator, e.g., flash drum, whose overhead is subsequently cracked, can be controlled within a range sufficient so the heated effluent is partially liquid, say, from about 260 to about 540° C. (500 to 1000° F.). This permits processing of a variety of feeds containing resid with greatly differing volatilities, e.g., atmospheric resid and crude at higher temperature and dirty liquid condensates, at lower temperatures. The temperature can be lowered as needed by: i) providing one or more additional downstream feed inlets to a convection section, ii) increasing the ratio of water/steam mixture added to the hydrocarbonaceous feed, iii) using a high pressure boiler feed water economizer to remove heat, iv) heating high pressure steam to remove heat, v) bypassing an intermediate portion of the convection section used, e.g., preheat rows of tube banks, and/or vi) reducing excess oxygen content of the flue gas providing convection heat.

7 Claims, 2 Drawing Sheets

U.S. PATENT DOCUMENTS

| | | | | |
|---|---|---|---|---|
| 3,505,210 | A | 4/1970 | Wallace et al. | 208/228 |
| 3,617,493 | A | 11/1971 | Wirth et al. | 208/80 |
| 3,677,234 | A | 7/1972 | Dutkiewicz | 122/240 |
| 3,718,709 | A | 2/1973 | Simonetta | 260/683 R |
| 3,900,300 | A | 8/1975 | Lehman | 96/181 |
| 4,071,586 | A | 1/1978 | Seger | |
| 4,107,226 | A | 8/1978 | Ennis, Jr. et al. | |
| 4,199,409 | A | 4/1980 | Skraba | 203/39 |
| 4,264,432 | A | 4/1981 | Gartside | 208/48 R |
| 4,300,998 | A | 11/1981 | Gartside | 208/127 |
| 4,311,580 | A | 1/1982 | Bartholic | 208/91 |
| 4,361,478 | A | 11/1982 | Gengler et al. | 208/130 |
| 4,400,182 | A | 8/1983 | Davies et al. | 48/214 |
| 4,426,278 | A | 1/1984 | Kosters | 208/130 |
| 4,501,644 | A | 2/1985 | Thomas | |
| 4,543,177 | A | 9/1985 | Murthy et al. | 208/130 |
| 4,587,011 | A | 5/1986 | Okamoto et al. | |
| 4,615,795 | A | 10/1986 | Woebcke et al. | 208/72 |
| 4,617,109 | A | 10/1986 | Wells et al. | |
| 4,693,086 | A | 9/1987 | Hoizumi et al. | |
| 4,714,109 | A | 12/1987 | Tsao | 165/104.18 |
| 4,732,740 | A | 3/1988 | Woebcke et al. | 422/193 |
| 4,840,725 | A | 6/1989 | Paspek | 208/130 |
| 4,854,944 | A | 8/1989 | Strong | 48/214 R |
| 4,879,020 | A | 11/1989 | Tsai | |
| 4,912,282 | A * | 3/1990 | Klaus | 585/648 |
| 4,954,247 | A | 9/1990 | Lipkin et al. | 208/355 |
| 5,096,567 | A | 3/1992 | Paspek, Jr. et al. | 208/106 |
| 5,120,892 | A | 6/1992 | Skraba | 585/652 |
| 5,190,634 | A | 3/1993 | Fernandez-Baujin et al. | 208/107 |
| 5,468,367 | A | 11/1995 | Dickakian et al. | 208/48 |
| 5,580,443 | A | 12/1996 | Yoshida et al. | 208/130 |
| 5,817,226 | A | 10/1998 | Lenglet | 208/130 |
| 5,910,440 | A | 6/1999 | Grossman et al. | 435/282 |
| 6,093,310 | A | 7/2000 | Swan | 208/113 |
| 6,123,830 | A | 9/2000 | Gupta et al. | 208/76 |
| 6,179,997 | B1 | 1/2001 | Vedder, Jr. et al. | 208/113 |
| 6,190,533 | B1 | 2/2001 | Bradow et al. | 208/57 |
| 6,210,561 | B1 | 4/2001 | Bradow et al. | 601/148 |
| 6,303,842 | B1 | 10/2001 | Bridges et al. | 585/648 |
| 6,376,732 | B1 | 4/2002 | Ngan et al. | 585/800 |
| 6,632,351 | B1 | 10/2003 | Ngan et al. | 208/132 |
| 6,743,961 | B2 | 6/2004 | Powers | 585/648 |
| 2001/0016673 | A1 | 8/2001 | Bridges et al. | 585/648 |
| 2003/0070963 | A1 | 4/2003 | Zimmermann et al. | 208/106 |
| 2004/0004022 | A1 | 1/2004 | Stell et al. | 208/106 |
| 2004/0004027 | A1 | 1/2004 | Spicer et al. | 208/130 |
| 2004/0004028 | A1 | 1/2004 | Stell et al. | 208/130 |
| 2004/0039240 | A1 | 2/2004 | Powers | 585/652 |
| 2004/0054247 | A1 | 3/2004 | Powers | 585/652 |
| 2005/0010075 | A1 | 1/2005 | Powers | 585/648 |

FOREIGN PATENT DOCUMENTS

| | | |
|---|---|---|
| EP | 0063448 | 10/1982 |
| FR | 1472280 | 3/1967 |
| GB | 199 766 | 6/1923 |
| GB | 998 504 | 7/1965 |
| GB | 1 053 751 | 1/1967 |
| GB | 1 203 017 | 8/1970 |
| GB | 1 233 795 | 5/1971 |
| GB | 2006259 | 10/1977 |
| GB | 2012176 | 11/1977 |
| NL | 7410163 | 4/1975 |
| RU | 1491552 | 7/1989 |
| WO | WO 01/55280 | 8/2001 |
| WO | WO 2004/005433 | 1/2004 |
| ZA | 907394 | 7/1991 |

OTHER PUBLICATIONS

Dennis A. Duncan and Vance A. Ham, Stone & Webster, "The Practicalities of Steam-Cracking Heavy Oil", Mar. 29-Apr. 2, 1992, AIChE Spring National Meeting in New Orleans, LA, pp. 1-41.

ABB Lummus Crest Inc., (presentation) HOPS, "Heavy Oil Processing System", Jun. 15, 1992 TCC PEW Meeting, pp. 1-18.

Mitsui Sekka Engineering Co., Ltd./Mitsui Engineering & Shipbuilding Co., Ltd., "Mitsui Advanced Cracker & Mitsui Innovative Quencher", pp. 1-16.

"Specialty Furnace Design: Steam Reformers and Steam Crackers", presented by T.A. Wells of the M.W. Kellogg Company, 1988 AIChE Spring National Meeting.

* cited by examiner

APPARATUS AND PROCESS FOR CONTROLLING TEMPERATURE OF HEATED FEED DIRECTED TO A FLASH DRUM WHOSE OVERHEAD PROVIDES FEED FOR CRACKING

FIELD OF THE INVENTION

The present invention relates to the cracking of hydrocarbons that contain relatively non-volatile hydrocarbons and other contaminants. More particularly, the present invention relates to controlling the temperature of a heated feed directed to a flash drum whose overhead is subsequently cracked, permitting the use of a variety of feeds.

BACKGROUND

Steam cracking, also referred to as pyrolysis, has long been used to crack various hydrocarbon feedstocks into olefins, preferably light olefins such as ethylene, propylene, and butenes. Conventional steam cracking utilizes a pyrolysis furnace that has two main sections: a convection section and a radiant section. The hydrocarbon feedstock typically enters the convection section of the furnace as a liquid (except for light or low molecular weight feedstocks which enter as a vapor) wherein it is typically heated and vaporized by indirect contact with hot flue gas from the radiant section and by direct contact with steam. The vaporized feedstock and steam mixture is then introduced into the radiant section where the cracking takes place. The resulting products including olefins leave the pyrolysis furnace for further downstream processing, including quenching.

Pyrolysis involves heating the feedstock sufficiently to cause thermal decomposition of the larger molecules. The pyrolysis process, however, produces molecules that tend to combine to form high molecular weight materials known as tar. Tar is a high-boiling point, viscous, reactive material that can foul equipment under certain conditions. In general, feedstocks containing higher boiling materials tend to produce greater quantities of tar.

The formation of tar after the pyrolysis effluent leaves the steam cracking furnace can be minimized by rapidly reducing the temperature of the effluent exiting the pyrolysis unit to a level at which the tar-forming reactions are greatly slowed. This cooling, achieved in one or more steps and using one or more methods, is referred to as quenching.

Conventional steam cracking systems have been effective for cracking high-quality feedstock which contains a large fraction of light volatile hydrocarbons, such as gas oil and naphtha. However, steam cracking economics sometimes favor cracking lower cost heavy feedstocks such as, by way of non-limiting examples, crude oil condensates and atmospheric residue, e.g., atmospheric pipestill bottoms. Crude oil, atmospheric residue and, to a lesser extent, condensate often contain high molecular weight, non-volatile components with boiling points in excess of about 590° C. (1100° F.) otherwise known as resids. The non-volatile components of these feedstocks lay down as coke in the convection section of conventional pyrolysis furnaces. Only very low levels of non-volatile components can be tolerated in the convection section downstream of the point where the lighter components have fully vaporized.

In most commercial naphtha and gas oil crackers, cooling of the effluent from the cracking furnace is normally achieved using a system of transfer line heat exchangers, a primary fractionator, and a water quench tower or indirect condenser.

The steam generated in transfer line exchangers can be used to drive large steam turbines which power the major compressors used elsewhere in the ethylene production unit. To obtain high energy-efficiency and power production in the steam turbines, it is necessary to superheat the steam produced in the transfer line exchangers.

Cracking heavier feeds, such as kerosenes and gas oils, produces large amounts of tar, which lead to moderate coking in the radiant section of the furnace as well as rapid fouling in the transfer line exchangers preferred in lighter liquid cracking service.

Additionally, during transport some naphthas and condensates are contaminated with heavy crude oil containing non-volatile components. Conventional pyrolysis furnaces do not have the flexibility to process residues, crudes, or many residue or crude contaminated gas oils or naphthas and condensates which are contaminated with non-volatile components.

To address coking problems, U.S. Pat. No. 3,617,493, which is incorporated herein by reference, discloses the use of an external vaporization drum for the crude oil feed and discloses the use of a first flash to remove naphtha as vapor and a second flash to remove vapors with a boiling point between 230 and 590° C. (450 and 1100° F.). The vapors are cracked in the pyrolysis furnace into olefins and the separated liquids from the two flash tanks are removed, stripped with steam, and used as fuel.

U.S. Pat. No. 3,718,709, which is incorporated herein by reference, discloses a process to minimize coke deposition. It describes preheating of heavy feedstock inside or outside a pyrolysis furnace to vaporize about 50% of the heavy feedstock with superheated steam and the removal of the residual, separated liquid. The vaporized hydrocarbons, which contain mostly light volatile hydrocarbons, are subjected to cracking. Periodic regeneration above pyrolysis temperature is effected with air and steam.

U.S. Pat. No. 5,190,634, which is incorporated herein by reference, discloses a process for inhibiting coke formation in a furnace by preheating the feedstock in the presence of a small, critical amount of hydrogen in the convection section. The presence of hydrogen in the convection section inhibits the polymerization reaction of the hydrocarbons thereby inhibiting coke formation.

U.S. Pat. No. 5,580,443, which is incorporated herein by reference, discloses a process wherein the feedstock is first preheated and then withdrawn from a preheater in the convection section of the pyrolysis furnace. This preheated feedstock is then mixed with a predetermined amount of steam (the dilution steam) and is then introduced into a gas-liquid separator to separate and remove a required proportion of the non-volatiles as liquid from the separator. The separated vapor from the gas-liquid separator is returned to the pyrolysis furnace for heating and cracking.

Co-pending U.S. application Ser. No. 10/188461 filed Jul. 3, 2002, Patent Application Publication US 2004/0004022 A1, published Jan. 8, 2004, which is incorporated herein by reference, describes an advantageously controlled process to optimize the cracking of volatile hydrocarbons contained in the heavy hydrocarbon feedstocks and to reduce and avoid coking problems. It provides a method to maintain a relatively constant ratio of vapor to liquid leaving the flash by maintaining a relatively constant temperature of the stream entering the flash. More specifically, the constant temperature of the flash stream is maintained by automatically adjusting the amount of a fluid stream mixed with the heavy hydrocarbon feedstock prior to the flash. The fluid can be water.

It would be advantageous to provide an apparatus and process for cracking hydrocarbons in which a wide variety of feeds could be employed. Inasmuch as controlling the temperature of the stream entering the flash has been found to be desirable for heavy feedstocks, controlling such temperature over a wider range would be additionally advantageous for utilizing feedstocks of various boiling point ranges. At times, condensates obtained from gas fields and typically boiling in the range of from about 38 to about 315° C. (100 to 600° F.) are economically attractive as cracking feeds. Such condensates are typically transported most efficiently on ships that usually carry crude. However, crude from previous cargos can contaminate the condensate with resid. When processed in conventional steam cracking equipment, all of the condensate and the non-volatile fraction of the crude oil contaminant will boil before reaching the flash drum used to remove the resid. As a result, the non-volatile fraction will laydown in upper convection tubes of a furnace as coke. Inasmuch as conventional steam/air decoking procedures are typically too cool to burn this coke present in the upper convection tubes, mechanical cleaning of the tubes is necessary at great expense. Although this problem might be avoided by cleaning the hold of a crude carrier to remove resids, this solution is expensive. Accordingly, it would be desirable to provide an apparatus and process for cracking feeds, including feeds that contain resids, which provide sufficient operating flexibility to prevent coke laydown associated with high flash drum operating temperatures.

SUMMARY

In one aspect, the present invention relates to an apparatus for cracking hydrocarbonaceous feed, which comprises: I) a convection zone containing: A) a first tube bank comprising 1) an upper hydrocarbon feed inlet, 2) an optional lower hydrocarbon feed inlet, 3) one or more inlets for introducing water and steam and 4) an outlet for a heated mixture stream; at least one of: B) a second tube bank positioned beneath the first tube bank comprising an economizer inlet for introducing high pressure boiler feed water and an economizer outlet for withdrawing boiler feed water of greater heat content; and C) a third tube bank positioned beneath the first tube bank comprising an inlet for high pressure steam which is heated in a section of the third tube bank, an inlet for mixing desuperheater water with the high pressure steam to cool the high pressure steam, a section for reheating the high pressure steam, and an outlet for withdrawing superheated high pressure steam; and further comprising: D) a bypass line for receiving the heated mixture stream from the first tube bank; E) a fourth tube bank positioned beneath the second tube bank and the third tube bank which comprises an inlet connected to the bypass line and an outlet for directing effluent to a vapor/liquid separator; and F) a fifth tube bank positioned beneath the fourth tube bank with an inlet for receiving overhead from the vapor/liquid separator and an outlet; and II) a radiant zone beneath the convection zone which includes a plurality of burners producing flue gas passing upwards through the radiant zone and convection tube banks, which radiant zone receives effluent from the fifth tube bank and further comprises an outlet for removing cracked effluent.

In another aspect, the present invention relates to a process for cracking hydrocarbonaceous feed that comprises: a) preheating the feed in a first tube bank of a convection zone of a furnace, the feed being introduced to the first tube bank through at least one of 1) an upper hydrocarbon feed inlet, and 2) a lower hydrocarbon feed inlet; b) mixing the hydrocarbon feedstock with water and steam added to the first tube bank via one or more inlets for introducing water and steam and removing the heated mixture stream through an outlet in the first tube bank, the water and steam being added in respective amounts which control the temperature of the heated mixture stream; c) further controlling the temperature of the heated mixture stream by at least one of: i) regulating the temperature of a second tube bank of the convection zone positioned beneath the first tube bank, by introducing high pressure boiler feed water through an economizer inlet and withdrawing boiler feed water of greater heat content through an economizer outlet; and ii) regulating the temperature of a third tube bank of the convection zone positioned beneath the first tube bank by introducing high pressure steam through an inlet for high pressure steam, heating the high pressure steam, mixing desuperheater water with the high pressure steam to cool the high pressure steam, reheating the high pressure steam and withdrawing superheated high pressure steam from the third tube bank through an outlet; d) directing the heated mixture stream by a bypass line substantially external to the convection zone for receiving the heated mixture stream from the first tube bank to a fourth tube bank positioned beneath the second tube bank and the third tube bank, which fourth tube bank comprises an inlet connected to the bypass line and an outlet for directing a partially liquid effluent to a vapor/liquid separator; e) flashing the effluent from the fourth tube bank effluent in the vapor/liquid separator external to the convection zone to provide a liquid bottoms phase and an overhead vapor phase; f) directing the overhead vapor phase to a fifth tube bank of the convection zone positioned beneath the fourth tube with an inlet for receiving overhead from the vapor/liquid separator and an outlet in order to further heat the overhead vapor phase; g) cracking the further heated overhead vapor phase in a radiant zone beneath the convection zone, which includes a plurality of burners producing flue gas passing upwards through the radiant zone and convection tube banks, to provide a cracked effluent; and h) withdrawing the cracked effluent from the radiant zone.

DETAILED DESCRIPTION

Figure 1:
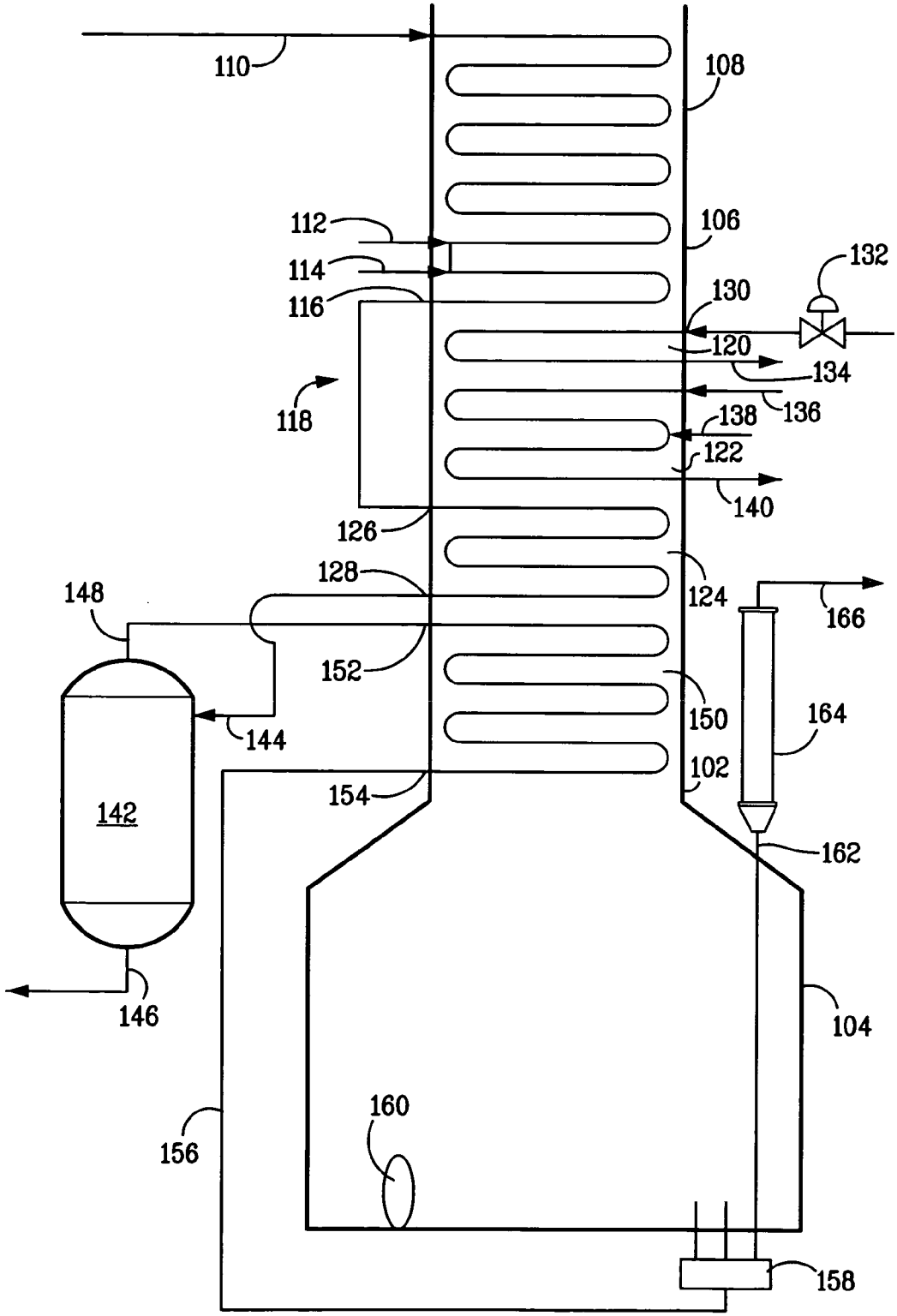
FIG. 1 illustrates a schematic flow diagram of the overall process and apparatus in accordance with the present invention wherein a variety of feeds are introduced through a single feed inlet.

Unless otherwise stated, all percentages, parts, ratios, etc. are by weight. Ordinarily, a reference to a compound or component includes the compound or component by itself, as well as in combination with other compounds or components, such as mixtures of compounds.

Further, when an amount, concentration, or other value or parameter is given as a list of upper preferable values and lower preferable values, this is to be understood as specifically disclosing all ranges formed from any pair of an upper preferred value and a lower preferred value, regardless of whether ranges are separately disclosed.

As used herein, resids are non-volatile components, e.g., the fraction of the hydrocarbon feed with a nominal boiling point above 590° C. (1100° F.) as measured by ASTM D-6352-98 or D-2887. This invention works very well with non-volatiles having a nominal boiling point above 760° C.

(1400° F.). The boiling point distribution of the hydrocarbon feed is measured by Gas Chromatograph Distillation (GCD) by ASTM D-6352-98 or D-2887 extended by extrapolation for materials boiling above 700° C. (1292° F.). Non-volatiles include coke precursors, which are large, condensable molecules that condense in the vapor, and then form coke under the operating conditions encountered in the present process of the invention.

Such feedstock could comprise, by way of non-limiting examples, one or more of steam cracked gas oil and residues, gas oils, heating oil, jet fuel, diesel, kerosene, gasoline, coker naphtha, steam cracked naphtha, catalytically cracked naphtha, hydrocrackate, reformate, raffinate reformate, Fischer-Tropsch liquids, Fischer-Tropsch gases, natural gasoline, distillate, virgin naphtha, atmospheric pipestill bottoms, vacuum pipestill streams including bottoms, wide boiling range naphtha to gas oil condensates, heavy non-virgin hydrocarbon streams from refineries, vacuum gas oils, heavy gas oil, naphtha contaminated with crude, atmospheric residue, heavy residue, hydrocarbon gases/residue admixtures, hydrogen/residue admixtures, C4's/residue admixture, naphtha/residue admixture, gas oil/residue admixture, and crude oil, especially crudes, atmospheric resids, contaminated condensates and contaminated naphthas.

The present invention relates to an apparatus or process for cracking hydrocarbonaceous feed, wherein the temperature of heated effluent directed to a vapor/liquid separator, e.g., flash drum, whose overhead is subsequently cracked, can be controlled within a range sufficient so the heated effluent is partially liquid, say, from about 260 to about 540° C. (500 to 1000° F.). This permits processing of a variety of feeds with differing volatility, e.g., atmospheric resid at higher temperature and dirty condensates, e.g., crude- or fuel oil-contaminated condensates, at lower temperature. For example, a very light crude such as Tapis has a moderate amount of resid, yet might need to enter the convection section at the lower inlet because, like condensates, it contains a lot of low molecular weight hydrocarbons-lights. These lights combine with steam/vaporized water to vaporize all but the non-volatile heavies at a low temperature. As long as some non-volatile resid is present, this temperature does not change much with resid concentration. The temperature can be lowered as needed by: i) providing one or more additional downstream feed inlets to a convection section, ii) increasing the ratio of water/steam mixture added to the hydrocarbonaceous feed, iii) using a high pressure boiler feed water economizer to remove heat, iv) superheating high pressure steam to remove heat, v) bypassing an intermediate portion of the convection section used, e.g., preheat rows of tube banks, as described above, and/or vi) reducing excess oxygen content of the flue gas providing convection heat. A radiant zone beneath the convection section includes a burner producing flue gas passing upwards through the tube banks. Typically, a plurality of burners is used which is sufficient to provide uniform flue gas heat release in the radiant zone, say, e.g., 10, 20, or even 50 or more burners.

In an embodiment of the present invention, the radiation zone includes a means for adjusting excess oxygen content of the flue gas, which provides temperature control for the convection section. A sample of flue gas exiting the radiant section of the furnace is cooled and analyzed for oxygen. The flue gas oxygen can be controlled as a function of analyzed oxygen content by adjusting dampers at the burner's air ducts, adjusting the dampers/louvers located either below or above the stack induced draft fan, and by adjusting the induced draft fan speed. Since flue gas analysis takes a relatively long time, the furnace draft, i.e., the difference in pressure between the top of the radiant section and the outside air, a rapidly responding parameter, is advantageously used to control the damper, louver and fan speed adjustments.

One embodiment of the present invention comprises a line which bypasses at least a portion of the fourth tube bank and whose effluent is directed to the vapor/liquid separator.

An embodiment of the present invention comprises a first transfer line exchanger for receiving cracked effluent from the radiant zone, the transfer line exchanger having an outlet for removing quenched effluent. A second transfer line exchanger can be placed downstream from the first transfer line exchanger to provide additional effluent quenching. A recovery train is placed downstream of the transfer line exchanger.

In one embodiment, the one or more inlets for introducing water and steam are associated with a sparger for mixing the water, steam and the feedstock.

In an embodiment, the upper inlet is used for introducing feeds selected from the group consisting of crude oil, atmospheric resids, and condensates which contain at least about 2 ppm by weight (ppm(w)) resids.

In one embodiment, the feeds to the upper inlet are selected from the group consisting of crude oil and atmospheric resids.

In one embodiment, the lower inlet is used for introducing feeds that contain at least about 2 ppm(w) resids. Typically, such feeds are condensates that contain at least about 350 ppm(w) resids. Where such feeds are employed, their temperature prior to introduction to the vapor/liquid separator can be provided at a lower temperature as needed by adjusting excess oxygen content of the flue gas. The excess oxygen content can be adjusted to at least about 4%, particularly for the less volatile heavy feeds. For more volatile lighter feeds, excess oxygen content is adjusted to no greater than about 3%, say, to no greater than about 1.5%.

In an embodiment, the process of the invention further comprises bypassing at least a portion of the fourth tube bank and directing effluent taken from an intermediate portion of the fourth tube bank to the vapor/liquid separator.

In an embodiment where a second transfer line exchanger further quenches the quenched cracked effluent from a first transfer line exchanger, the olefins from the further quenched cracked effluent are recovered in a recovery train.

In one embodiment of the process, the hydrocarbonaceous feed containing resid is selected from light crude oil and condensate contaminated with resids in the effluent from the fourth tube bank directed to the vapor/liquid separator is maintained at temperatures less than about 315° C. (600° F.). Typically, the temperatures of the fourth tube bank effluent are less than about 290° C. (550° F.), say, from about 260 to about 540° C. (500 to 1000° F.).

In an embodiment of the process of the invention, the hydrocarbonaceous feed containing resid is selected from the group consisting of crude oil and atmospheric resid (e.g. atmospheric pipestill bottoms) in the effluent from the fourth tube bank is directed to the vapor/liquid separator is maintained at temperatures of at least about 400° C. (750° F.), say, at least about 460° C. (860° F.), e.g., ranging from about 400 to about 540° C. (750 to 1000° F.).

In one embodiment of the process, the feed is introduced to the first tube bank through the upper hydrocarbon feed inlet.

In an embodiment, the feed is introduced to the first tube bank through the lower hydrocarbon feed inlet. Typically, the feed contains at least about 2 ppm(w) resid.

In another embodiment of the process, the feed is introduced to the first tube bank through both 1) an upper hydrocarbon feed inlet, and 2) a lower hydrocarbon feed inlet. The feed can be selected from the group consisting of crude oil and atmospheric resid.

In an embodiment of the process, a feed that contains less than about 50 wt. % resid is introduced to the first tube bank through the upper hydrocarbon feed inlet. The feed can be selected from the group consisting of crude oil, atmospheric resid, and heavy or contaminated condensate.

FIG. 1 depicts an apparatus for cracking hydrocarbonaceous feeds selected from disparate sources, including crudes, atmospheric resids and condensates wherein all feeds enter through the same inlet. The apparatus comprises a furnace 102 comprising a radiant section 104 and a convection section 106 comprising a convection zone containing a first tube bank 108 comprising an upper hydrocarbon feed inlet 110, inlet for introducing water 112, and inlet for introducing steam 114, e.g., via a dual sparger, the respective amounts of water and steam controlling temperature in the apparatus, to a limited extent. By swapping water for steam up to about 9 MW (30 MBtu/hr) of heat is absorbed, reducing the temperature in flash drum 142 by about 55 to about 110° C. (100 to 200° F.). An outlet 116 is provided for a heated mixture stream from the first tube bank 108 and feeds into a process jumpover or bypass line 118 which bypasses a second tube bank 120 and a third tube bank 122 to a fourth tube bank 124 positioned below the second and third tube banks through fourth tube bank inlet 126 and the heated stream passes through fourth tube bank outlet 128. A separate second tube bank 120 is an economizer whose economizer inlet 130 is controlled by valve 132 for introducing high pressure boiler feed water added at a temperature of about 110° C. (230° F.), further heated within the furnace 102 to a temperature of up to about 310° C. (590° F.) and removed as boiler feed water of greater heat content via economizer outlet 134 and directed to a steam drum/boiler. When crudes and atmospheric resid feeds (with relatively low volatility) are cracked, less or no high pressure boiler feed water flows through the economizer. This maximizes flue gas temperature above the economizer. When high volatility feeds are cracked, e.g., dirty condensates and dirty naphthas, more high pressure boiler feed water flows through the economizer, producing cooler flue gas and relatively cool condensate above the economizer. The economizer can absorb roughly an additional 9 MW (30 MBtu/hr). The economizer allows energy efficient furnace operation no matter which feed is cracked. For example, because some liquid must be present in the mixture entering the separator drum, its temperature is lower for dirty condensates than for crudes or atmospheric resids. The lower temperature provides a lower crossover temperature and a greater radiant heat requirement or furnace firing per unit of condensate than crude or atmospheric resid. At constant maximum firing, the condensate feed rate to the radiant zone is about 10 to about 20% less than for the heavier feeds, resulting in excess heat entering the convection zone. But the greater flow of high pressure boiler feed water in the economizer absorbs the extra heat entering the convection section, which is in turn converted to additional valuable high pressure steam in the steam drum. Thus, compared to a conventional furnace, during condensate operations, less feed is cracked, but more high pressure steam is produced. The separate third tube bank 122 is positioned beneath the first tube bank and comprises an inlet 136 for high pressure steam, an inlet 138 for mixing desuperheater water with said high pressure steam and reheating said high pressure steam, and an outlet 140 for withdrawing superheated high pressure steam. Saturate steam, typically at 10500 kPa/315° C. (1500 psig/600° F.) is fed from the steam drum at the top of the furnace to a bank of convection tubes which heat the steam to about 482° C. (900° F.). Then, just exterior to the convection section, high pressure boiler feed water is added to the high pressure steam through a combined control valve atomizer assembly called the desuperheater. The steam is quenched to about 315° C. (600° F.) and is subsequently reheated to about 510° C. (950° F.). This 510° C. (950° F.) outlet temperature is controlled by the quantity of the high pressure water added through the desuperheater. The intermediate steam quenching by the desuperheater allows the use of less expensive convection tube alloys and produces more high pressure steam than other ways of controlling the outlet temperature.

Inasmuch as it is important that the feed to the liquid/vapor separation apparatus or flash drum 142 be at least partially liquid, the temperature of the heated mixture stream exiting from fourth tube bank outlet 128 is advantageously maintained at a temperature to effect this, say, less than about 290° C. (550° F.) for condensates. At 290° C. the resid, a fraction of the remaining crude oil contaminant and a small fraction of the condensate comprise the liquid phase. For feeds such as crudes and atmospheric resids, where less or no heat is removed by the economizer or by vaporized sparger water, the temperature of the feed entering the flash drum can be at least about 425° C. (800° F.). At this temperature, most but not all of the crude or atmospheric resid is in the vapor phase.

The heated mixture stream from fourth tube bank outlet 128 is directed to flash drum (or knockout drum) 142 through flash drum inlet 144 which can be substantially tangential to the drum wall to effect swirling. Liquid hydrocarbon resid is removed through bottoms outlet 146 and a vaporous overhead, e.g., a clean steam/hydrocarbon vapor, is removed through overhead outlet 148. The vaporous overhead then passes to fifth tube bank 150, positioned beneath the fourth tube bank, via inlet 152 for further heating and is removed via outlet 154 through crossover line 156 and manifold 158 to radiant zone 104 which includes burners 160 producing flue gas passing upwards through the radiant zone and convection tube banks.

The amount of excess oxygen in the flue gas can be controlled, providing yet an additional means to broaden the temperature range used in the process. When cracking low volatility feeds, the furnace can be operated with relatively high excess oxygen in the flue gas, say, from about 4 to about 6%. But when cracking high volatility feeds, the excess oxygen can be reduced below about 4%, say, e.g., 2% or even lower. This reduces heat to the convection section by about 3 MW to about 9 MW (10 to 30 MBtu/hr).

The effluent from the fifth tube bank outlet is cracked in the radiant zone and cracked effluent is removed through outlet 162. The cracked effluent can pass from outlet 162 to one or more transfer line exchangers 164 and thence to a recovery train via line 166. The cracking of certain feeds such as condensates can result in low flash drum and crossover temperatures which tend to require addition of more heat by the radiant zone where cracking occurs, e.g., condensate typically requires about 85° C. (150° F.) additional heating and thus effects higher tube metal temperatures and excessive coking in the radiant zone. These conditions can be ameliorated by increasing the length of the coil (or tube) employed in the radiant zone, say, from about 2 to about 20%, e.g., about 10%, for example, extending a radiant coil from about 12 m to about 13 m (40 to 44 feet), which results in a slightly lower selectivity for crude or atmospheric resid cracking, but longer run-lengths for all feeds.

Figure 2:
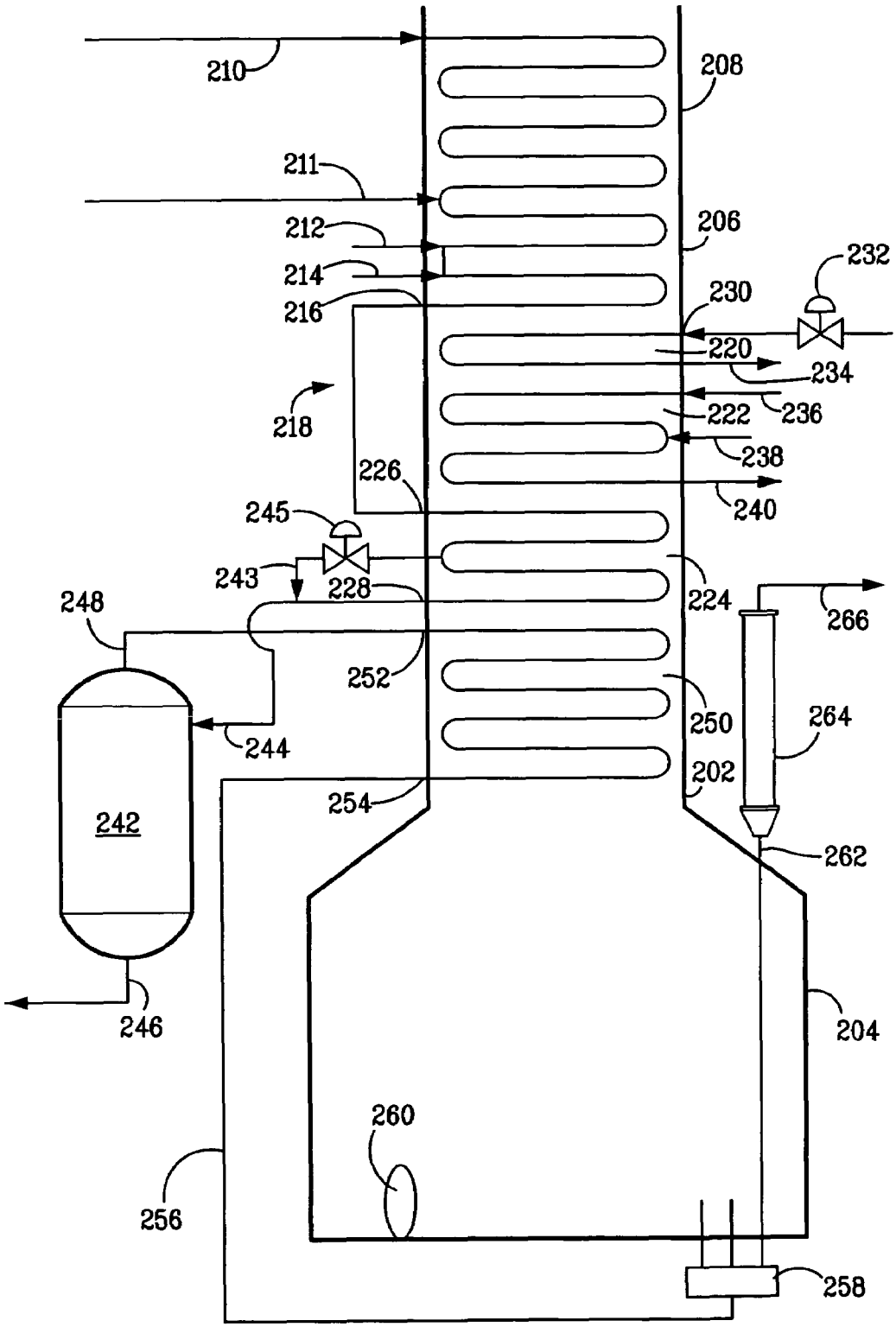
FIG. 2 illustrates a schematic flow diagram of the overall process and apparatus in accordance with the present invention wherein a variety of feeds are introduced through a plurality of feed-specific inlets with an optional heater bypass used for condensate feeds requiring less heating before flashing.

FIG. 2 depicts an apparatus for cracking hydrocarbonaceous feeds selected from disparate sources, including crudes, atmospheric resids and condensates. Feeds such as crudes and atmospheric resids requiring more heating enter through an upper inlet while feeds such as dirty condensates, naphthas and kerosenes requiring less heating are added downstream in a lower inlet and are exposed to less convection heat transfer area.

The apparatus comprises a furnace 202 comprising a radiant section 204 and a convection section 206 comprising a convection zone containing a first tube bank 208 comprising an upper hydrocarbon feed inlet 210, for introducing feeds such as crudes and atmospheric resids, a lower hydrocarbon feed inlet 211 for introducing feeds such as dirty condensates, an inlet for introducing dilution water 212, and inlet for introducing dilution steam 214, the respective amounts of dilution water and steam controlling temperature to an extent in the apparatus. An outlet 216 is provided for a heated mixture stream from the first tube bank 208 and feeds into a process jumpover or bypass line 218 which bypasses a second tube bank 220 and a third tube bank 222 to a fourth tube bank 224 positioned below the second and third tube banks through fourth tube bank inlet 226 and the heated stream passes via fourth tube bank outlet 228.

A separate second tube bank 220 is an economizer whose economizer inlet 230 is controlled by valve 232 for introducing high pressure boiler feed water added at a temperature of about 110° C. (230° F.), heated within the second tube bank 220 to a temperature of up to about 310° C. (590° F.) and is removed as high pressure boiler feed water of greater heat content via economizer outlet 234 for further treatment, say, by a steam drum/boiler.

The separate third tube bank 222 is positioned beneath the first tube bank and comprises an inlet 236 for high pressure steam, an inlet 238 for mixing desuperheater water with said high pressure steam, reheating of said high pressure steam, and an outlet 240 for withdrawing superheated high pressure steam.

Inasmuch as it is important that the feed to the liquid/vapor separation apparatus or flash drum 242 be at least partially liquid, the temperature of the heated mixture stream exiting from fourth tube bank outlet 228 is typically maintained at a temperature to effect this. The heated mixture stream from fourth tube bank outlet 228 is directed to flash drum (or knockout drum) 242 through flash drum inlet 244. One way of reducing the temperature of the heated mixture stream directed to the flash drum is to provide a bypass line 243 around a portion of the fourth tube bank outlet 228 to the flash drum inlet 244. The bypass line 243 is controlled by valve 245 and is especially suited for feeds such as dirty condensates introduced at lower temperature. Hydrocarbon resid is removed through bottoms outlet 246 and vaporous overhead through overhead outlet 248. The vaporous overhead then passes to fifth tube bank 250, positioned beneath the fourth tube bank, via inlet 252 for further heating and is removed via outlet 254 through crossover line 256 and manifold 258 to radiant zone 204 which includes burners 260 producing flue gas passing upwards through the radiant zone and convection tube banks. The amount of excess oxygen in the flue gas can be controlled. The effluent from the fifth tube bank outlet is cracked in the radiant zone and cracked effluent is removed through outlet 262. The cracked effluent can pass from outlet 262 to one or more transfer line exchangers 264 and thence to a recovery train via line 266.

The heating of the hydrocarbon feedstock can take any form known by those of ordinary skill in the art. However, it is preferred that the heating comprises indirect contact of the hydrocarbon feedstock in the upper (farthest from the radiant section) convection section tube bank of the furnace with hot flue gases from the radiant section of the furnace. The heated hydrocarbon feedstock typically has a temperature between about 110 and about 260° C. (230 and 500° F.), such as from about 110 to about 230° C. (230 to 450° F.), for example, from about 110 to about 220° C. (230 to about 425° F.).

While the present invention has been described and illustrated by reference to particular embodiments, those of ordinary skill in the art will appreciate that the invention lends itself to variations not necessarily illustrated herein. For this reason, then, reference should be made solely to the appended claims for purposes of determining the true scope of the present invention.

We claim:

1. An apparatus for cracking a variety of hydrocarbonaceous feed, which comprises:

(I) a convection zone containing:

(a) a first tube bank comprising (i) an upper hydrocarbon feed inlet, (ii) an optional lower hydrocarbon feed inlet, (iii) one or more inlets for introducing water and steam, and (iv) an outlet for a heated mixture stream;

(b) a vapor/liquid separator receiving the heated mixture stream from a fourth tube bank;

(c) a second tube bank positioned beneath said first tube bank comprising an economizer inlet for introducing high pressure boiler feed water and an economizer outlet for withdrawing boiler feed water of greater heat content, including means for controlling high pressure boiler feed water through said economizer inlet, responsive to the temperature of the heated mixture stream entering the vapor/liquid separator over a wide range by regulating the temperature of said second tube bank;

(d) a third tube bank positioned beneath said first tube bank comprising an inlet for high pressure steam which is heated in a section of said third tube bank, an inlet for mixing desuperheater water with said high pressure steam to cool the high pressure steam, a section for reheating said high pressure steam, and an outlet for withdrawing superheated high pressure steam;

(e) a bypass line for receiving said heated mixture stream from said first tube bank;

(f) a fourth tube bank positioned beneath said second tube bank and said third tube bank which comprises an inlet connected to said bypass line and an outlet for directing effluent to said vapor/liquid separator; and (g) a fifth tube bank positioned beneath said fourth tube bank with an inlet for receiving overhead from said vapor/liquid separator and an outlet; and (II) a radiant zone beneath said convection zone which includes a plurality of burners producing flue gas passing upwards through the radiant zone and convection tube banks, which radiant zone receives effluent from said fifth tube bank and further comprises an outlet for removing cracked effluent.

2. The apparatus of claim 1 wherein said radiation zone includes a means for adjusting excess oxygen content of said flue gas.

3. The apparatus of claim 1 that further comprises a line which bypasses at least a portion of said fourth tube bank and whose effluent is directed to said vapor/liquid separator.

4. The apparatus of claim 1 that further comprises a first transfer line exchanger for receiving cracked effluent from said radiant zone said transfer line exchanger having an outlet for removing quenched effluent.

5. The apparatus of claim 4 that further comprises a second transfer line exchanger downstream from said first transfer line exchanger to provide additionally quenched effluent.

6. The apparatus of claim 4 that further comprises a recovery train downstream of said transfer line exchanger.

7. The apparatus of claim 1 wherein said one or more inlets for introducing water and steam are associated with a sparger.

* * * * *